United States Patent [19]

Dorfman et al.

[11] Patent Number: 4,822,415

[45] Date of Patent: Apr. 18, 1989

[54] THERMAL SPRAY IRON ALLOY POWDER CONTAINING MOLYBDENUM, COPPER AND BORON

[75] Inventors: Mitchell R. Dorfman, Smithtown; Subramaniam Rangaswamy, Stony Brook; Joseph D. Reardon, Happauge, all of N.Y.

[73] Assignee: Perkin-Elmer Corporation, Norwalk, Conn.

[21] Appl. No.: 801,035

[22] Filed: Nov. 22, 1985

[51] Int. Cl.[4] ..... C22C 38/20

[52] U.S. Cl. ..... 75/251; 427/423; 427/427; 420/35; 420/64; 420/67; 420/68; 420/69

[58] Field of Search ..... 420/582, 35, 64, 67–69; 75/128 F, 125, 123 B, 126 P, 126 C, 251; 428/937; 427/423, 427, 34

[56] References Cited

U.S. PATENT DOCUMENTS

| | | | |
|---|---|---|---|
| 2,111,278 | 3/1938 | Charlton | 75/125 |
| 2,185,006 | 12/1939 | Welch et al. | 75/126 P |
| 2,185,618 | 1/1940 | Welch et al. | 75/126 P |
| 2,754,200 | 7/1956 | Cape | 75/125 |
| 3,145,287 | 8/1964 | Siebein et al. | 427/236 |
| 3,839,100 | 10/1974 | Ota | 75/125 |
| 3,900,316 | 8/1975 | Jones | 75/128 F |
| 3,977,838 | 8/1976 | Hashimoto et al. | 75/123 B |
| 4,064,608 | 12/1977 | Jaeger | 428/684 |
| 4,098,608 | 11/1978 | Matty et al. | 75/251 |
| 4,116,682 | 9/1978 | Polk et al. | 75/123 H |
| 4,194,900 | 3/1980 | Ide et al. | 75/251 |
| 4,216,015 | 8/1980 | Hickl et al. | 420/582 |
| 4,473,401 | 9/1984 | Masumoto et al. | 75/126 P |
| 4,536,232 | 8/1985 | Khandros et al. | 75/125 |

FOREIGN PATENT DOCUMENTS

| | | | |
|---|---|---|---|
| 53-20444 | 6/1978 | Japan | 75/125 |
| 59-123746 | 7/1984 | Japan | 75/125 |
| 0195575 | 5/1967 | U.S.S.R. | 420/582 |

*Primary Examiner*—L. Dewayne Rutledge
*Assistant Examiner*—Deborah Yee
*Attorney, Agent, or Firm*—Herbert S. Ingham; F. L. Masselle; E. T. Grimes

[57] ABSTRACT

A novel iron based alloy is disclosed which is characterized by high resistance to wear and corrosion. The alloy consists essentially of 0 to 40% chromium, 1 to 40% molybdenum, 1 to 15% copper, 0.2 to 5% boron, and 0.01 to 2% carbon; the balance being incidental impurities and at least 30% iron, with the molydenum being at least 10% if the boron is greater than 2%. The alloy is preferably in the form of a powder for thermal spraying, and coatings produced thereby may have an amorphous structure.

3 Claims, No Drawings

THERMAL SPRAY IRON ALLOY POWDER CONTAINING MOLYBDENUM, COPPER AND BORON

This invention relates to an iron alloy composition containing molybdenum, copper and boron, characterized by improved wear and corrosion resistance, and to a process for thermal spraying such alloy.

BACKGROUND OF THE INVENTION

Thernal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns.

A thermal spray gun normally utilizes a combustion or plasma flame to produce the heat for melting of the powder particles. It is recognized by those of skill in the art, however, that other heating means may be used as well, such as electric arcs, resistance heaters or induction heaters, and these may be used alone or in combination with other forms of heaters. In a powder-type combustion thermal spray gun, the carrier gas, which entrains and transports the powder, can be one of the combustion gases or an inert gas such as nitrogen, or it can be simply compressed air. In a plasma spray gun, the primary plasma gas is generally nitrogen or argon. Hydrogen or helium is usually added to the primary gas. The carrier gas is generally the same as the primary plasma gas, although other gases, such as hydrocarbons, may be used in certain situations.

The material alternatively may be fed into a heating zone in the form of a rod or wire. In the wire type thermal spray gun, the rod or wire of the material to be sprayed is fed into the heating zone formed by a flame of some type, such as a combustion flame, where it is melted or at least heat-softened and atomized, usually by blast gas, and then propelled in finely divided form onto the surface to be coated. In an arc wire gun two wires are melted in an electric arc struck between the wire ends, and the molten metal is atomized by compressed gas, usually air, and sprayed to a workpiece to be coated, the rod or wire may be conventionally formed as by drawing, or may be formed by sintering together a powder, or by bonding together the powder by means of an organic binder or other suitable binder which disintegrates in the heat of the heating zone, thereby releasing the powder to be sprayed in finely divided form.

A class of materials known as hard facing alloys are used for coatings produced, for example, by thermal spraying. Such alloys of iron contain boron and silicon which act as fluxing agents during processing and hardening agents in the coatings. Generally the alloy coatings are used for hard surfacing to provide wear resistance, particularly where a good surface finish is required.

An iron alloy for surfacing may contain chromium, boron, silicon and carbon, and may additionally contain molybdenum and/or tungsten. For example U.S. Pat. No. 4,064,608 discloses iron-base hardfacing alloys that range in composition from (in weight percentages) about 0.5 to 3% Si, about 1 to 3% B, 0 to 3% C, about 5 to 25% Cr, 0 to 15% Mo, 0 to 15% W and the balance essentially iron. This alloy is indicated therein for application on yankee drier rolls for the processing of paper, involving wet, corrosive conditions at elevated temperature. This alloy is not as good as may be desired with respect to acid corrosion and frictional wear.

In certain instances copper is incorporated in a molybdenum-containing alloy. U.S. Pat. No. 4,536,232 describes a cast iron alloy of (in weight percentages) about 1.2 to 2 carbon, 1–4 nickel, 1–4 molybdenum, 24–32 chromium, up to 1 copper and up to about 1% of a microalloying element that may include boron.

A similar group of iron alloys may exist in an amorphous form. They contain such elements as molybdenum and/or tungsten, and boron, silicon and/or carbon. The alloys are prepared with the amorphous structure by rapid quenching from the melt. For example amorphous ribbon may be produced by quenching a stream of molten alloy on a chilled surface as described in U.S. Pat. No. 4,116,682. A practical method of processing such alloys into a directly useful form is by thermal spraying to produce a coating.

Aforementioned U.S. Pat. No. 4,116,682 describes a class of amorphous metal alloys of the formula MaTbXc wherein M may be iron, cobalt, nickel and/or chromium; T may include molybdenum and tungsten; and X may include boron and carbon. The latter group X of boron, etc. has a maximum of 10 atomic percent which calculates to about 1.9% by weight for boron in the amorphous alloys; thus boron is characteristically low compared to the boron content in the ordinary hardfacing alloys.

An amorphous iron based alloy directed to fatigue property is disclosed in U.S. Pat. No. 4,473,401, containing, in atomic percent: 25% or less of Si; 2.5 to 25% of B, providing that the sum of Si and B falls in the range of 17.5 to 35%; 1.5 to 20% of Cr; 0.2 to 10% of P and/or C; 30% or less of at least one element of a group of twelve that includes Mo and Cu; balance Fe; with effective maximums given as 5% for Mo and 2.5% for Cu. In converted units the maximum for copper is about 0.8% by weight. Alloys of this type are limited in wear resistance and acid corrosion resistance.

The iron based compositions are of interest for their low cost compared to nickel and cobalt alloys. However, for the combined properties of corrosion resistance, frictional wear resistance and abrasive wear resistance, further improvements in these properties are desired.

In view of the foregoing, a primary object of the present invention is to provide a novel iron alloy composition characterized by the combination of corrosion resistance, frictional wear resistance and abrasive wear resistance.

A further object of this invention is to provide an improved amorphous type of alloy for the thermal spray process.

Another object is to provide an improved thermal spray process for producing corrosion and wear resistant coatings.

BRIEF DESCRIPTION OF THE INVENTION

The foregoing and other objects are achieved by an alloy generally having a composition of, as percent of weight:

0 to 40% chromium,
1 to 40% molybdenum,
1 to 15% copper,
0.2 to 5% boron,
0 to 5% silicon,
0.01 to 2% carbon, and
balance incidental impurities and at least 30% iron; the molybdenum being at least 10% if the boron is at least 2%.

DETAILED DESCRIPTION OF THE INVENTION

According to the present invention, an alloy material has been developed which has a high degree of resistance to both wear and corrosion. The alloy is especially suitable for thermal spraying onto metallic substrates by conventional thermal spray equipment.

The aloy composition of the present invention is broadly in the range of, by weight:
0 to 40% chromium,
1 to 40% molybdenum,
1 to 15% copper,
0.2 to 5% boron,
0 to 5% silicon,
0.01 to 2% carbon, and
balance incidental impurities and at least 30% iron; the molybdenum being at least 10% if the boron is greater than 2%.

In one embodiment, in which the alloy is relatively low in boron content and is capable of being in the amorphous form, the ranges are as follows:
0 to 40% chromium,
1 to 30% molybdenum,
1 to 15% copper,
0.2 to 2% boron,
0 to 3% silicon,
0.01 to 2% carbon, and
balance incidental impurities and at least 30% iron; the total of boron and carbon being less than about 3.0%.

In this embodiment a preferred composition is:
20 to 30% chromium,
1 to 20% molybdenum,
2 to 8% copper,
0.5 to 2% boron,
0 to 1% silicon,
0.01 to 1% carbon, and
balance incidental impurities and at least 50% iron.

In a second embodiment, that contains more boron and may have less tendency toward the amorphous form, the composition is as follows:
0 to 40% chromium,
10 to 40% molybdenum,
1 to 15% copper,
2 to 5% boron,
0 to 5% silicon,
0.01 to 2% carbon, and
balance incidental impurities and at least 30% iron;

A preferred composition for this second embodiment is:
10 to 30% chromium,
10 to 30% molybdenum,
1 to 5% copper,
3 to 4% boron,
0 to 4% silicon,
0.01 to 1% carbon, and
balance incidental impurities and at least 50% iron.

As indicated for the second embodiment the amount of molybdenum is not as low as for the first, in conjunction with the higher amount of boron. Thus if the boron content is higher than about 2%, the molybdenum content is higher than 10% in order to maximize the combination of abrasive wear resistance and frictional (sliding) wear resistance.

Optional elements are nickel, cobalt and manganese, totalling up to about 20%, and preferably less than 15%, by weight, to improve corrosion resistance and ductility. Other optional elements that may be included in the composition are zirconium, tantalum, niobium, tungsten, yttrium, titanium, vanadium and hafnium, totalling up to about 30%, and preferably less than 10%, by weight, to form carbides and further improve wear and corrosion resistance. Further optional elements may be phosphorous, germanium and arsenic, totalling up to about 2%, and preferably less than 1%, to reduce melting point. Otherwise incidental impurities should be less than about 2% and preferably 0.5%.

Alloys having compositions according to the present invention, particularly in coating form, such as produced by a welding or thermal spray process, are surprisingly low in oxide content, even when prepared in air. They have a combination of resistance to abrasive wear, adhesive (sliding) wear and corrosion, that is especially unique for iron based alloys.

Alloys of the first embodiment described hereinabove having lower boron content also are quite likely to exist in amorphous form if produced by quenching. Such form further enhances the above combination of favorable properties.

Although the composition of the present invention may be quite useful in cast, sintered, or welded form, or as a quenched powder or ribbon or the like, it is especially suitable for application as a coating produced by thermal spraying.

As a thermal spray material the composition should be in alloy form (as distinct from a composite of the constituents) since the desirable benefit is obtained with the maximum homogeneity available therefrom. Alloy powder of size and flowability suitable for thermal spraying is one such form. Such powder should fall in the range between 100 mesh (U.S. standard screen size) (149 microns) and about 2 microns. For example, a coarse grade may be −140 +325 mesh (−105 +44 microns), and a fine grade may be −325 mesh (−44 microns) +15 microns. The thermal spray material may be used as is or, for example, as a powder blended with another thermal spray powder such as tungsten carbide.

When used for thermal spraying the alloy thermal spray material need not have the amorphous structure and even may have the ordinary macro-crystalline structure resulting from the normal cooling rates in the usual production procedures. Thus the thermal spray powder may be made by such standard method as atomizing from the melt and cooling the droplets under ambient condition. The thermal spraying then melts the particles which quench on a surface being coated, providing a coating that may be substantially or entirely amorphous, particularly if the composition is within the first, low-boron embodiment described hereinabove. By using the usual manufacturing procedures the production of the thermal spray powder is kept relatively simple and costs are minimized.

The powders are sprayed in the conventional manner, using a powder-type thermal spray gun, though it is also possible to combine the same into the form of a composite wire or rod, using plastic or a similar binder, as for example, polyethylene or polyurethane, which decomposes in the heating zone of the gun. Alloy rods or wires may also be used in the wire thermal spray processes. The rods or wires should have conventional sizes and accuracy tolerances for flame spray wires and thus, for example, may vary in size between 6.4 mm and 20 gauge.

Alloy coatings of the present invention show significant improvements in both wear resistance and corrosion resistance over prior coatings. The coatings are excellently suited as bearing and wear surfaces, particularly where there are corrosive conditions as, for example, for coating yankee dryer rolls; automotive and diesel engine piston rings; pump components such as shafts, sleeves, seals, impellors, casing areas, plungers; Wankel engine components such as housing, end plates; and machine elements such as cylinder liners, pistons, valve stems and hydraulic rams.

EXAMPLE 1

A thermal spray alloy powder of the following composition by weight according to the present invention was prepared by nitrogen atomization from the melt:
17.6% chromium,
9.8% nickel,
3.4% molybdenum
3.2% copper,
1.8% boron,
0.05% carbon,
balance iron and incidental impurities.

The powder was sized to about −170 +325 mesh (−105 +44 microns) and was macrocrystalline in structure. It was thermal sprayed with a plasma gun of the type described in U.S. Pat. No. 3,145,287 and sold by Metco Inc. as Type 7MB with a #6 Powder Port and GP Nozzle, using the following parameters: argon primary gas at 6.7 bar pressure and 72 standard l/min flow, hydrogen secondary gas at 3.3 bar pressure and 9 l/min flow, arc at 80 volts and 500 amperes, powder feed rate 3 kg per hour using argon carrier gas at 9 l/min, and spray distance 15 cm. A pair of air cooling jets parallel and adjacent to the spray stream were used. The substrate was cold rolled steel prepared by grit blasting in the normal manner.

Coatings up to 1.3 mm thick were produced that were about 60% amorphous according to X-ray diffraction measurements. Porosity was less than about 0.5%, and oxide content was less than about 2%. Macrohardness was Rc 32.

EXAMPLE 2

A second thermal spray alloy powder of the following composition was similarly prepared:
16.3% chromium,
15.6% molybdenum,
3.1% copper,
3.6% boron,
3.9% silicon,
0.5% carbon,
balance iron and incidental impurities.

The powder was of similar size and was thermal sprayed in substantially the same manner as the powder of Example 1. Porosity was less than about 1%, and oxide content was not detected metallographically. Macrohardness was Rc 45; microhardness averaged DPH(300) 700 to 800.

EXAMPLE 3

Powder of the same composition as Example 2 was prepared except the size was −325 mesh (44 microns) +15 microns. Spray gun parameters were the same as given in Example 1. Porosity was less than about 1%, and oxide content was not detected metallographically. Macrohardness was Rc 40; microhardness averaged DPH(300) 700 to 800.

EXAMPLE 4

The alloy powders set forth in Table 1, not within the scope of the present invention, were similarly prepared and sprayed with the parameters of Example 1. Powder Alloy Nos. 4, 5, 6 and 7 were of the size given in Example 1. Powder Alloy No. 8 was finer, as given in Example 3.

TABLE 1

| Alloy | ELEMENTS WT % | | | | | | | | | |
|---|---|---|---|---|---|---|---|---|---|---|
| No. | Fe | Ni | Mn | Cr | B | Si | C | Cu | Mo | V |
| 4 | 55.0 | 8.51 | 7.5 | 19.0 | — | 4.0 | 0.2 | 2.0 | 3.5 | — |
| 5 | 83.72 | — | 0.88 | — | 0.017 | 0.60 | 0.9 | 2.64 | 10.6 | 0.66 |
| 6 | 83.0 | — | 0.8 | — | 0.60 | — | 1.0 | — | 11.0 | 0.8 |
| 7 | 69.0 | — | — | 16.5 | 4.0 | 4.0 | 0.5 | 3.0 | 3.0 | — |
| 8* | 69.0 | — | — | 16.5 | 4.0 | 4.0 | 0.5 | 3.0 | 3.0 | — |

8* Fine size powder

The coatings of the examples were tested for corrosion resistance by removing the coatings from the substrates and exposing them to 25% hydrochloric acid solution at about 25 degrees centigrade for 3 hours. Results were determined in mm/year corrosion rate.

Abrasive wear resistance for the example alloys was measured by placing coated samples in sliding motion against a cast iron plate with a slurry of 150 gms of between 53 and 15 micron aluminum oxide abrasive powder in 500 ml of water. A load of 3.3 kg/cm was applied and the surface motion was about 122 cm/sec for 20 minutes. Wear resistance is presented as a ratio of loss for a similarly tested fused coating of thermal sprayed AMS 4775A, which is considered an industry standard, to the coating loss for each example.

Sliding wear resistance for the alloy of the example was determined with an Alpha LFW-1 friction and wear testing machine sold by Fayville-Levalle Corp., Downers Grove, Ill., using a 3.5 cm diameter test ring and 45 kg load at 197 RPM for 12,000 revolutions. Coefficient of friction is given, as is an indication of seizure (if any).

Results are given in Table II for all of the example alloys for the above-indicated tests.

TABLE II

| Alloy No. | Abrasive Wear Resistance Relative to Fused AMS 4775A (%) | Metal-Metal Wear (LFW) Coeff. of Friction | Acid Corrosion 10% HCL (mm/yr) | Comments |
|---|---|---|---|---|
| 1* | 95 (Excellent) | .17 (Good) | 63 (Good) | Min. oxide |
| 2* | 80 (Very Good) | .18 (Good) | 38 (Good) | No oxide |
| 3* | 80 (Very Good) | .15 (Very Good) | 38 (Good) | No oxide |
| 4 | 39 (Poor) | .34 (Seized-Poor) | 127 (Poor) | High oxide |
| 5 | 56 (Poor) | .17 (Good) | 163 (Poor) | High oxide |
| 6 | 95 (Excellent) | .18 (Good) | 216 (Poor) | Overall poor corrosion |
| 7 | 47 (Poor) | .17 (Good) | 51 (Good) | Porous, brittle |
| 8 | 80 (Very Good) | .21 (Seized-Poor) | 51 (Good) | Dense abrasive |

*Examples 1, 2 and 3 according to present invention.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray powder characterized by ability to produce coatings having high resistance to wear and corrosion, comprising a homogeneous alloy consisting essentially of, in weight percent:

10 to 30% chromium,
10 to 30% molybdenum,
1 to 5% copper,
3 to 4% boron,
0 to 4% silicon,
0.01 to 1% carbon, and
balance incidental impurities and at least 50% iron.

2. The thermal spray alloy powder of claim 1 wherein the additional components are present in an amount of:

up to 15% total of one or more first elements selected from the group consisting of nickel, cobalt and manganese;
up to 10% total of one or more second elements selected from the group consisting of zirconium, tantalum, niobium, tungsten, titanium, vanadium, and hafnium; and
up to 2% total of one or more third elements selected from the group consisting of phosphorous, germanium and arsenic.

3. A thermal spray process comprising the step of thermal spraying the alloy powder of claim 1 or 2 to produce a coating.

* * * * *